United States Patent [19]

Morehouse

[11] Patent Number: 4,961,296

[45] Date of Patent: Oct. 9, 1990

[54] CURTAIN ROD HANGER

[76] Inventor: David F. Morehouse, 29 Mafalda, Cheektowaga, N.Y. 14225

[21] Appl. No.: 401,500

[22] Filed: Aug. 29, 1989

Related U.S. Application Data

[63] Continuation of Ser. No. 176,664, Apr. 1, 1988, abandoned.

[51] Int. Cl.[5] ..... A47H 1/00

[52] U.S. Cl. ..... 52/37; 52/27; 248/261; 248/201; 160/330

[58] Field of Search ..... 248/261–263, 248/267, 251–255, 201; 160/330; 52/37, 27

[56] References Cited

U.S. PATENT DOCUMENTS

| | | | |
|---|---|---|---|
| 1,063,800 | 6/1913 | Hughes | 248/262 X |
| 1,074,973 | 10/1913 | Newberger | 248/262 |
| 1,580,706 | 4/1926 | Wright | 248/263 X |
| 1,606,168 | 11/1926 | Lindberg | 248/262 |
| 1,763,764 | 6/1930 | Dignan | 248/262 |
| 2,634,078 | 4/1953 | Aiello et al. | 248/262 |
| 2,682,385 | 6/1954 | Schluter | 248/262 |
| 3,090,588 | 5/1963 | Monette | 248/262 X |
| 3,218,017 | 11/1965 | Butler | 248/263 |

FOREIGN PATENT DOCUMENTS

| | | | |
|---|---|---|---|
| 691319 | 7/1964 | Canada | 248/263 |

*Primary Examiner*—Karen J. Chotkowski

*Attorney, Agent, or Firm*—Edwin T. Bean, Jr.; Martin G. Liniham; John C. Thompson

[57] ABSTRACT

A curtain rod hanger for mounting between a wall and the frame of a window or door associated with the wall utilizes an elongate portion adapted to be snuggly received endwise and thereby secured between opposing surfaces of the wall and the frame. The elongate portion is plate-like in shape with two opposite flat side surfaces so that when operatively positioned between opposing surfaces of the wall and frame, the opposite side surfaces of the elongate portion engage the opposing wall and edgepiece surfaces. The hanger further includes a rod-supporting portion attached to the elongate portion and of size and shape that when the elongate portion is securely positioned between the opposing surfaces of the wall and frame edgepiece, the rod-supporting portion is in condition for supporting a curtain rod operatively placed thereupon. The rod-supporting means is of such configuration that the hanger can be operatively utilized on either the right-hand or left-hand side of the frame.

10 Claims, 1 Drawing Sheet

Fig. 1.
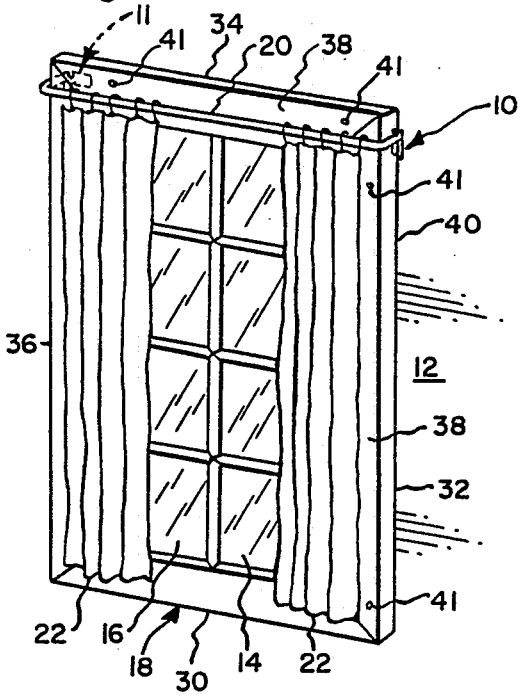
Fig. 2.
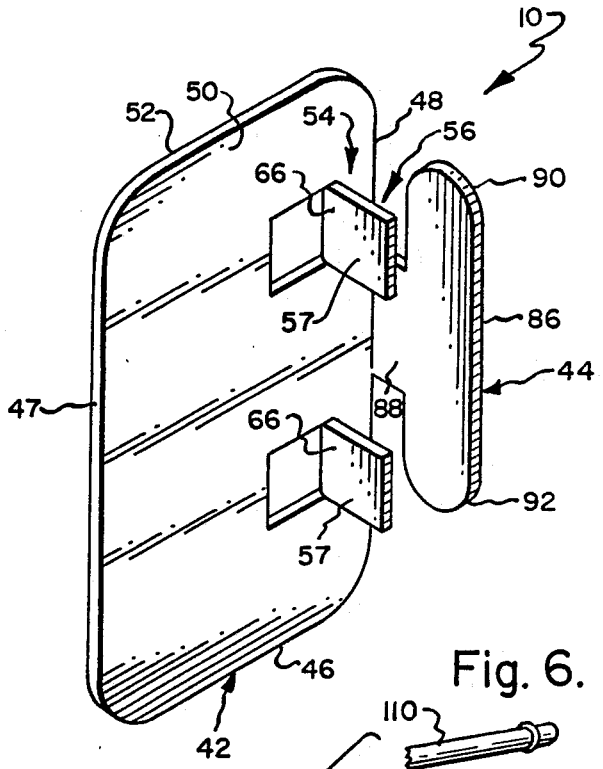
Fig. 3.
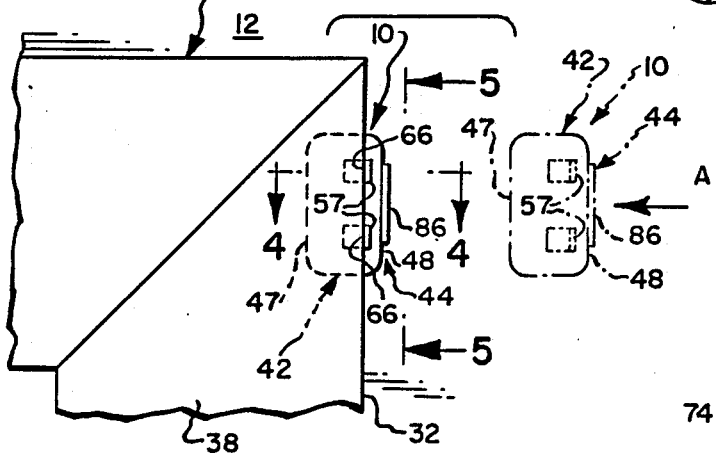
Fig. 6.
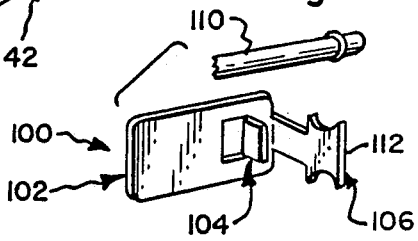
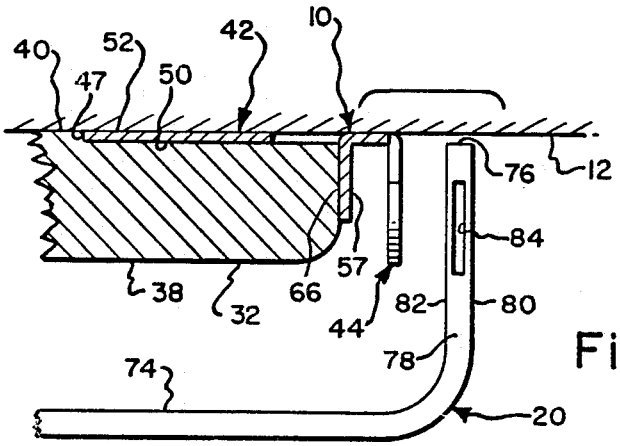
Fig. 4.
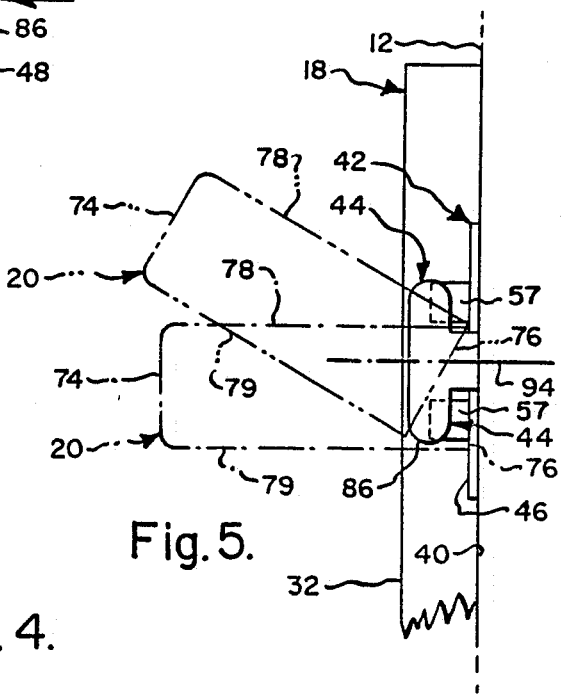
Fig. 5.

CURTAIN ROD HANGER

This application is a continuation of application Ser. No. 176,664, filed Apr. 1, 1988, now abandoned.

BACKGROUND OF THE INVENTION

This invention relates generally to apparatus for supporting a curtain across the frame of a window or door and relates more particularly to a hanger for supporting a curtain rod.

The type of curtain rod hanger with which this invention is to be compared includes a base plate portion and a rod-supporting portion attached to the base plate portion so as to project from one side thereof. When utilized to support a curtain rod across the frame of a window or door, the base plate portion is typically affixed to a surface of the frame so that the rod-supporting portion projects generally away from the frame surface. The rod-supporting portion is thereby arranged in condition for supporting a curtain rod operatively placed thereupon.

Curtain rod hangers of the aforedescribed type are commonly affixed to the surface of a frame with nails or screws directed through the base plate portion and into the frame so that the base plate portion is securely held between the frame surface and the heads of the nails or screws. The utilization of either nails or screws, of course, necessitates the formation of holes in the frame for accepting the shanks of the nails or screws, and such holes mar the frame surface. If such a curtain rod hanger, once attached to the frame as aforesaid, is removed from the frame so that the formed holes are exposed to view, the holes may detract from the appearance of the frame. Furthermore, inasmuch as frames to which such curtain rod hangers are attached are commonly constructed of wood, nails or screws operatively directed into the frame may be responsible for splits or cracks in the frame material, which splits or cracks may also detract from the appearance of the frame. Still further, inasmuch as such splits or cracks commonly reduce the effective area of the frame within which a nail or screw can be stably secured, such splits or cracks can render difficult a reattachment of a hanger to the frame or the reattachment of a replacement hanger to the frame.

Accordingly, it is an object of the present invention to provide a new and improved curtain rod hanger capable of being affixed to the frame of a window or door in a manner preserving the appearance of the frame.

Another object of the present invention is to provide such a curtain rod hanger which can be installed without nails or screws.

Still another object of the present invention is to provide such a curtain rod hanger which remains securely in place when installed and is capable of supporting a relatively large amount of weight.

Yet still another object of the present invention is to provide such a curtain rod hanger capable of being installed upon and removed from the frame quickly and with relative ease.

A further object of the present invention is to provide such a curtain rod hanger which can be used on either the right or left side of the frame for supporting a curtain rod thereacross.

A still further object of the present invention is to provide such a curtain rod hanger which is uncomplicated in structure and relatively inexpensive to manufacture.

SUMMARY OF THE INVENTION

This invention resides in a curtain rod hanger for mounting between a wall and the frame of a window or door associated with the wall wherein the frame includes an edge piece having a surface which generally opposes the surface of the wall.

The curtain rod hanger includes attachment means and associated rod-supporting means upon which a curtain rod is positioned when operatively supported by the hanger. The attachment means has an elongate portion adapted to be snuggly received endwise and thereby secured between the opposing surfaces of the wall and the edge piece of the frame associated with the wall. The rod-supporting means includes a projecting portion attached to the elongate portion so as to project from one side thereof so that when the elongate portion is securely positioned between the opposing surfaces of the wall and frame edge piece as aforesaid, the projecting portion is in condition for supporting a curtain rod operatively placed thereupon.

BRIEF DESCRIPTION OF THE DRAWING FIGURES

FIG. 1 is a perspective view of a window frame with which an embodiment of a curtain rod hanger in accordance with the present invention is utilized.

FIG. 2 is a perspective view of the hanger of FIG. 1.

FIG. 3 is a front elevation view of a portion of the FIG. 1 window frame and hanger.

FIG. 4 is a cross-sectional view taken about on lines 4—4 of FIG. 3.

FIG. 5 is a side elevation view of the FIG. 1 window frame and hanger as seen from the right in FIG. 3.

FIG. 6 is a perspective view of an alternative embodiment of a curtain rod hanger in accordance with the present invention.

DETAILED DESCRIPTION OF THE ILLUSTRATED EMBODIMENTS

Turning now to the drawings in greater detail and considering first FIG. 1 there is illustrated an embodiment of a pair of curtain rod hangers indicated 10 and 11, of identical construction and a typical environment in which the curtain rod hangers 10, 11 are utilized. More specifically, the environment includes a wall 12 and a window 14 associated with the wall 12. The window 14 includes a glass portion 16 and a frame 18 positioned about the glass portion 16. A curtain rod 20 is associated with the frame 18 of the window 14 so as to span the width thereof, and a pair of curtains 22 are attached to the curtain rod 20 so as to drape downwardly therefrom. As is described herein, the curtain rod hanger 10 is utilized to support the curtain rod 20 across the window 14 although it will be understood that the principles of this invention can be applied to frames of other wall-associated structures such as door frames.

With reference still to FIG. 1, the window frame 18 includes four pieces of decorative molding or edgepieces 30, 32, 34, 36 joined together in a rectangular configuration. Each edgepiece 30, 32, 34, 36 is constructed of wood, and as best illustrated in FIG. 3, defines a front surface 38 which generally faces away from the wall 12, an opposite back surface 40 which generally opposes or faces the wall 12 and an edge 32 joining the front and back surfaces 38 and 40. The back surface 40 is substantially flat and is positioned flat against the surface of the wall 12. Although the edgepieces 30, 32, 34, and 36 can be held against the wall surface by any of a number of suitable means, the edgepieces 30, 32, 34, 36 are fixed to the wall 12 by means of nails 41 (FIG. 1) extending through the edgepieces and into the wall 12.

In accordance with the present invention and with reference to FIG. 2, the curtain rod hanger 10 includes means, indicated 42, for attachment of the hanger 10 to the window 14 and means, indicated 44, for securing the curtain rod 20 to the hanger 10. The attachment means 42 is shaped so as to be insertable between the back surface 40 of edgepiece 32 and the wall 12. To this end, the attachment means 42 includes a thin, elongate plate-like portion 46 having two opposite ends 47, 48 and opposite front and back surfaces 50, 52, respectively, and wherein the portion 46 is adapted to be snuggly received endwise into place between the back surface 40 of frame edgepiece 32 and the wall 12. Once operatively and snuggly positioned between the edgepiece 32 and wall 12, the hanger 10 is secured in place by what is believed to be the frictional engagement between the back surface 40 of edgepiece 32 and the front surface 50 of the plate-like portion 46 and between the back surface 52 of the plate-like portion 46 and the wall 12.

To operatively install the hanger 10 between the wall 12 and edgepiece 32 and with reference to FIG. 3, the hanger 10 is 12 positioned as illustrated in phantom in FIG. 3, against the wall 12 so that the back surface 50 of the plate-like portion 46 is flat against the wall 12 and the edge 47 of the plate-like portion 46 is directed toward the region between the wall W and edgepiece 32 at which the hanger 10 is desired to be secured. Accordingly, the hanger 10 is positioned adjacent the edgepiece 32 and at about the elevation along the edgepiece 32 at which the curtain rod 20 is desired to be mounted. The hanger 10 is then moved in the direction of the arrow A to operatively insert the plate-like portion 46 edgewise between the wall 12 and back surface 40 of the edgepiece 32. It will be understood that as the plate-like portion 46 is operatively inserted as aforesaid, the edge 47 of the plate-like portion 46 precedes the edge 48. Hence, when the plate-like portion 46 is inserted edgewise into place, the edge 48 is the first edge of the plate-like portion 46 to move between the wall 12 and edgepiece surface 40.

In the wall/window frame environment illustrated in FIG. 1, the back surface 40 of the edgepiece 32 lies flatly against the wall 12 so that the hanger 10 may be required to be driven into place between the wall 12 and edgepiece 32. Such a driving of the hanger 10 may be effected by lightly tapping the edge 48 of the plate-like portion 46 with a hammer to force the hanger 10 to move in the direction of the arrow A (FIG. 3). It will be understood, however, that the hanger 10 is well-suited for use in wall/window frame environments in which the wall and frame edgepiece are spaced slightly apart so that a gap exists therebetween. In such an environment, the plate-like portion 46 can be manually inserted edgewise into place and thereby snuggly held thereat between the wall and edgepiece surface.

The hanger 10 further includes means, generally indicated 54, associated with the attachment means 42 for limiting the edgewise movement of the plate-like portion 46 when operatively inserted endwise between the wall and frame edgepiece. Such limiting means 54 includes stop means, generally indicated 56, attached to plate-like portion 46 as best shown in FIG. 2. The stop means 56 includes a pair of stops 57, 57 which each define an abutment surface 56 oriented at generally a right angle to the front surface 50. Each abutment surface 66 or 66 is generally directed toward the end 47 of the plate-like portion 46 and positioned at a predetermined distance therefrom. Each stop 57 or 57 is generally rectangular in shape and integrally joined to the plate-like portion 46. The stops 57, 57 of the hanger 10 are formed in a stamping process wherein a rectangular blank out of which the plate-like portion 46 is made is stamped so that the stops 57, 57 project at a right angle to the blank. Alternatively, each stop 57 can be constructed separately of the plate-like portion 46 and subsequently attached thereto.

When the hanger 10 is operatively inserted between the wall 12 and edgepiece 32 and with reference again to FIG. 3, the plate-like portion 46 is moved in the direction of the arrow A until the abutment surfaces 66, 66 of the stops 57, 57 abut the side surface of the edgepiece 32 and halt further movement of the hanger 10 in the direction of the arrow A. Accordingly, the stops 57, 57 possess sufficient size and rigidity to halt the further movement of the hanger 10 as aforedescribed. It also follows that the location of the abutment surfaces 66, 66 relative to the length of the plate-like portion 46 permits the plate-like portion 46 to be inserted between the wall 12 and edgepiece surface 40 in the direction of the FIG. 3 arrow A a distance equal to the distance as measured between the edge 47 and abutment surface 66.

In addition to limiting the endwise movement of the plate-like portion 46 as aforesaid, the stops 57, 57 are further advantageous in that they provide means facilitating the removal of the hanger 10 from its position between the wall 12 and edgepiece 32. More specifically, the stops 57, 57 provide means which can be grasped with an appropriate tool, such as a pair of pliers, and readily withdrawn by appropriately manipulating the tool.

With reference to FIG. 4 there is illustrated an end portion 74 of the curtain rod 20 of the type supported by the hanger 10. The end portion end 76 is arcuate in shape and includes a top 78, a bottom 79 (FIG. 5) two sides 80, 82 and a receiving channel 84 extending between and opening out of the top 78 and bottom 79. Furthermore, the end portion 74 terminates at an open and hollow end 76.

For supporting the rod end portion 74 from the hanger 10 and with reference again to FIG. 2, the hanger 10 includes a rod-supporting means, generally designated 44, upon which a curtain rod 20 is positioned when operatively supported by the hanger 10. The rod-supporting means is attached to the plate-like portion 46 at end 48 thereof so as to project from one side, or from the front surface 50 of the plate-like portion 46 and is shaped in the form of a projection 86 adapted to cooperatively interfit with the rod end 76 placed thereupon. To this end, the rod-supporting means 44 is planar and generally T-shaped, as viewed from the plate-like portion edge 47, so as to define a base section 88 attached to the plate-like portion 46 at the edge 48 thereof and upwardly and downwardly-projecting finger sections 90 and 92, respectively, as shown in FIG. 2. The T-shaped projection 86 is arranged generally in a plane oriented at a right angle to the plate-like portion 86 and is symmetrical in shape about a midplane 94 (FIG. 5) oriented generally perpendicular to the plate-like portion 46 and arranged so as to bisect the projection 86.

Hence, the upwardly and downwardly-projecting finger sections 90 and 92 are similarly-shaped.

To install the rod 20 upon the hanger 10 and with reference to FIG. 5, the end portion 74 of the rod 20 is oriented in a canted relationship with respect to the T-shaped projection 86 and directed over the upwardly-directed finger section 90 so that the opening of the channel 42 defined in the top 78 accepts the finger section 90. At that point, the rod end portion 74 is lowered to a horizontal orientation as the rod end 76 generally pivots about the hanger 10 so that the open end 76 accepts the downwardly-directed finger section 92 and abuts the plate-like portion 46. The rod end portion 74 is thereby interlocked with the hanger 10 and maintained in a generally horizontal orientation as the receiving channel 84 of the rod 76 is hooked upon the upwardly-directed finger section 90 and the rod end 76 bears against the plate-like portion 46. It follows from the foregoing that the opening in the end 76 of the rod 20 is sufficient in size to accept both the upwardly and downwardly projecting finger sections 90 and 92.

Because the upwardly and downwardly-shaped finger sections 90 and 92 are similarly-shaped, the hanger 10 can be utilized on either the left-hand or right-hand side of the window frame 18. For example and with reference to FIG. 5, the hanger 10 is illustrated in a right-side-up condition with its upwardly-directed finger section 90 arranged above the downwardly-directed finger section 92 for utilization on the right-hand side, as shown in FIG. 1, of the window frame 18. By turning the hanger 10 upside down so that its finger section 92 is arranged above the finger section 90, the hanger 10 is in condition to be inserted between the wall 12 and edgepiece 34 oriented on the left-hand side, as viewed in FIG. 1, of the frame 18. Hence, the hanger 10 can be selectively used on either the right-hand or left-hand side of the window frame 18.

For exemplary purposes, the following dimensions of the hanger 10 are provided as follows: the thickness of the plate-like portion 46 is about 0.031 inches (0.079 cm); the distance as measured across the edge 47 of plate-like portion 46 is about 1.75 inches (4.45 cm); the distance as measured between the edges 47 and 48 is about 1.0 inches (2.54 cm); the distance as measured between the edge 47 and each stop 57 is about 0.875 inches (2.22 cm); the height of each stop 57 or 57 as measured from the front surface 50 of the plate-like portion 46 to the tip of the stop 57 or 57 is about 0.25 inches (0.64 cm); the width of the base section 88 of the T-shaped projection 86 as measured in the plane thereof is about 0.375 inches (0.95 cm); the distance between the front surface 50 and each finger section 90 or 92 is about 0.125 inches (0.318 cm); the width of the projection 86 as measured generally in the plane thereof and from the tip of one finger section 90 to the tip of the other finger section 92 is about 1.0 inches (2.5 cm); and the height of the projection 86 as measured from the front surface 50 to the edge of the projection 86 opposite the plate-like portion 46 is about 0.375 inches (0.95 cm).

The material out of which the hanger 10 is constructed can be any of a number of suitable materials, such as a steel or another appropriate metal or hard plastic.

It will be understood that numerous modifications and substitutions can be had to the aforedescribed hanger embodiment 10 without departing from the spirit of the invention. For example and with reference to FIG. 6, there is shown an alternative embodiment 100 of the hanger of this invention including attachment means 102 in the form of a plate, a single stop 104 attached to so as to project from one side of the attachment means 102 and rod-securement means 106 attached to the attachment means 102. Whereas the T-shaped projection 86 of the hanger 10 of FIGS. 1–5 is shaped to interfit with the end portion 74 having a receiving channel 84 as aforedescribed, the rod-securement means 106 of the FIG. 6 hanger 100 is shaped to support a cylindrical rod 110 operatively laid thereacross. More specifically, the rod-securement means 106 includes a section 112 defining an upwardly-directed U and a downwardly-directed U as viewed in FIG. 6. Each U of the section 112 is of sufficient size to accept and thereby support the end of the rod 110 positioned therein when oriented so as to open upwardly. Accordingly, the aforedescribed embodiment is intended for purposes of illustration and not as limitation.

I claim:

1. A curtain rod hanger in combination with a window or door frame assembly mounted within a wall including molding surrounding the periphery edge of said frame assembly adjoining the wall surface, said molding having a planar rear surface which generally opposes the surface of the adjoining wall surface, a front surface and an edge therebetween, said hanger comprising:

attachment means having an elongate portion adapted to be received solely between the planar rear surface of said molding and the adjoining wall surface; and rod supporting means positioned between the front surface of said molding and the adjoining wall surface immediately adjacent the edge of said molding upon which a curtain rod is positioned between the front surface of said molding and the adjoining wall surface immediately adjacent the edge of said molding when operatively supported by the hanger, the rod supporting means including a projecting portion attached to the elongate portion so as to project from one side thereof so that when the elongate portion is securely positioned solely between the planar rear surface of said molding and the adjoining wall surface, the projecting portion is positioned perpendicular to the adjoining wall surface and the front surface of said molding immediately adjacent the edge of said molding.

2. A rod hanger according to claim 1 wherein the elongate portion is plate-like in form.

3. A rod hanger according to claim 2 wherein the elongate portion is generally rectangular in shape and defines two opposite flat side surfaces.

4. The rod hanger according to claim 1, wherein said elongate portion is of such size and shape that when inserted endwise into position between the planar rear surface of said molding and the adjoining wall surface, said elongate portion is frictionally engaged by the adjoining wall surface and said molding rear surface so that the elongate portion is maintained therebetween as aforesaid.

5. A rod hanger according to claim 1, wherein one end of said elongate portion precedes the other end of said elongate portion when inserted into operative position between the planar rear surface of said molding and the adjoining wall surface, said elongate portion further including stop means associated therewith, said stop means defining an abutment surface oriented to one side of said elongate portion for limiting the endwise movement thereof when operatively inserted endwise between the planar rear surface of said molding and the adjoining wall surface.

6. A rod hanger according to claim 1, wherein one end of said elongate portion is inserted into operative position between the planar rear surface of said molding and the adjoining wall surface and said other end of said elongate portion being attached to said projecting portion of said rod supporting means.

7. A rod hanger according to claim 1, wherein said projecting portion of said rod supporting means is adapted to support a curtain rod operatively placed thereupon if oriented right side up or upside down so that the hanger can be selectively and operatively mounted between the planar rear surface of said molding and the adjoining wall surface on either the left-hand and right-hand side of the window or door frame assembly.

8. A rod hanger according to claim 7 wherein the projecting portion is symmetrical in shape about a mid-plane generally parallel to the longitudinal axis of said elongate portion and so as to bisect the projecting portion.

9. A curtain rod hanger in combination with a window or door frame assembly mounted within a wall and a curtain rod for spanning the window or door frame assembly, said frame assembly including molding surrounding the periphery edge of said frame assembly adjoining the wall surface, said molding having a planar rear surface which generally opposes the adjoining wall surface, a front surface and an edge therebetween, said hanger comprising:

attachment means having an elongate portion defining two opposite ends and of such size and shape that one end of said attachment means is insertable solely between the rear planar surface of said molding and the adjoining wall surface so that when inserted therebetween, said attachment means is snugly and securely maintained in position solely between the corresponding set of opposing surfaces; and rod supporting means positioned between the front surface of said molding and the adjoining wall surface immediately adjacent the edge of said molding immediately adjacent said molding upon which a curtain rod is positioned when operatively supported by the hanger, the rod supporting means including a projecting portion attached to the elongate portion so as to project from one side thereof so that when the elongate portions of the hangers are operatively positioned solely between the planar rear surface of said molding and the adjoining wall surface and on opposite sides of said frame assembly, the projecting portions of the hanger are positioned perpendicular to the front surface of said molding and the adjoining wall surface immediately adjacent the edge of said molding in position for supporting said curtain rod operatively placed thereupon.

10. In combination:

a window or door frame assembly mounted within a wall and associated with the adjoining wall surface, said frame assembly including molding surrounding the periphery edge of said frame assembly having a rear surface plane which generally opposes the adjoining wall surface, a front surface and an edge therebetween;

a curtain rod hanger for supporting a curtain rod across said frame assembly, said curtain rod hanger including attachment means and rod supporting means associated therewith, said attachment means including an elongate portion adapted to be inserted endwise and thereby snugly received solely between the rear surface plane of said molding and the adjoining wall surface, and at least one stop means attached to said elongate portion, said stop means defining an abutment surface oriented to one side of said elongate portion for positioning said attachment means at a predetermined distance between said molding rear surface and the adjoining wall surface, said rod supporting means including a projecting portion attached to said elongate portion and positioned between the front surface of said molding and the adjoining wall surface immediately adjacent the edge of said molding so as to project from one side thereof so that when said elongate portion is operatively positioned solely between said molding rear surface and the adjoining wall surface and on opposite sides of the frame, the projecting portion of said curtain rod hanger is in condition for supporting the curtain rod operatively placed thereupon.

* * * * *